US005163578A

United States Patent [19]

Eitreim et al.

[11] Patent Number: 5,163,578

[45] Date of Patent: Nov. 17, 1992

[54] SEALABLE TRANSPORTATION AND STORAGE CONTAINER

[75] Inventors: Jeffrey D. Eitreim, Mound; Dennis N. Harvey, Victoria, both of Minn.

[73] Assignee: Trillium Products, Inc., Victoria, Minn.

[21] Appl. No.: 754,921

[22] Filed: Sep. 4, 1991

Related U.S. Application Data

[63] Continuation-in-part of Ser. No. 593,664, Oct. 5, 1990, abandoned.

[51] Int. Cl.[5] ..... B65D 1/24

[52] U.S. Cl. ..... 220/526; 220/505; 220/344; 220/213; 190/109; 206/545

[58] Field of Search ..... 220/526, 523, 556, 505, 220/378, 344, 575, 507, 553, 213; 190/109; 206/545, 541, 550

[56] References Cited

U.S. PATENT DOCUMENTS

| | | | |
|---|---|---|---|
| 514,488 | 2/1894 | Moore | 220/213 |
| 1,208,189 | 12/1916 | Miller | 220/553 |
| 1,336,776 | 4/1920 | Drinkwater | 206/545 |
| 1,716,367 | 6/1929 | Clayton | 220/526 |
| 2,096,825 | 10/1937 | Roman | 220/575 |
| 2,577,959 | 12/1951 | Gattuso | 206/545 |
| 2,683,642 | 7/1954 | Stoleson | 220/523 |
| 3,258,369 | 6/1966 | Blaich | 220/526 |
| 3,805,018 | 4/1974 | Luong et al. | 206/545 |
| 3,811,562 | 5/1974 | Smith | 220/526 |
| 4,898,300 | 2/1990 | Cohen et al. | 220/526 |

*Primary Examiner*—Stephen Marcus
*Assistant Examiner*—S. Castellano
*Attorney, Agent, or Firm*—Lawrence M. Nawrocki

[57] ABSTRACT

A device for use in transporting and storing materials. The device includes a housing which is defined by a bottom panel and four generally planar panels extending substantially perpendicular to the bottom panel. A generally rectangular compartment is defined within those four panels which extend perpendicular to the bottom panel. Upper edges of two opposite of the panels perpendicular to the bottom panel are convexly arcuate and parallel to one another. The upper edges of the other two panels are also convex and parallel to one another. The device further includes a generally planar closure panel including a lower surface which carries a compressible seal. The seal is of a size at least as great as an area defined by the upper edges of the four panels which are perpendicular to the bottom panel of the housing. The seal cooperates intimately with the upper edges of the four panels, when the closure panel is brought into engagement with the top of the housing, to seal the compartment defined within the four panels.

14 Claims, 2 Drawing Sheets

SEALABLE TRANSPORTATION AND STORAGE CONTAINER

CROSS-REFERENCE TO RELATED APPLICATION

This document is a continuation-in-part of co-pending application Ser. No. 07/593,664 filed Oct. 5, 1990, abandoned.

TECHNICAL FIELD

The present invention is in the field of containers for transporting and storing solid, liquid, and gelatinous substances. More particularly, the present invention relates to aggressively sealable containers used to transport and hold food items. Yet more particularly, the present invention pertains to food transportation and storage means such as for example, lunch boxes, which are internally sealable so as to obviate the need for individual food wrappings.

BACKGROUND OF THE INVENTION

U.S. Pat. No. 4,340,138 to Daniel Bernhardt discloses nesting first and second containers preferably formed from polymeric materials. The nesting containers of Bernhardt employ a cellophane membrane or seal disposed in registry with the first container and optionally in registry with the second container to provide a composite package which includes discrete components having multiple seals. In this manner, multiple (i.e., double) sealing of the containers is provided.

SUMMARY OF THE INVENTION

In one aspect, the present invention is a food transportation and storage device comprising a housing having a bottom and a top or cover. The bottom of the device is further defined by a bottom panel having, upstanding from the perimeter thereof, two side panels, a back panel and a front panel. The bottom has multiple compartments therein which are defined by interior divider panels upstanding from the bottom panel. The top or upper edges, or lands, of the divider panels can be staggered, longitudinally innermost inner walls being provided with greater heights so that top or upper edges, or lands, thereof protrude above top or upper edges, or lands, of outwardly adjacent walls. Such upper edges can also be made convex. A bow, with respect to both of two mutually-perpendicular axes, can, thereby, be induced in the cover or top as the cover or top is appropriately secured to the bottom of the device in order to induce a better seal.

The top comprises a top panel with integral back, side and front rims, said top further comprising an elastomeric, compressible sealing panel interiorly covering a portion of the top panel, the sealing panel being located within said top panel so that, when said top panel is placed upon said bottom and urged thereagainst, the seal is compressed, by said top panel, against said divider panel edges to seal said compartments.

In a preferred practice of the present invention, the back panel and back rim have cooperating hinge means, e.g., hinges, which permit said top and said bottom to pivot with respect to each other. In yet another practice of this invention, the front rim and front panel have cooperating latch means, e.g., latches, which positively maintain said top against said bottom.

In a preferred practice of the present invention, the device includes one or more hinge means on the back panel and back rim thereof, and one or more latch means on the front panel and front rim which, when said top is latched to said bottom, compresses said sealing panel against the top edges of the divider panels to seal the interior compartments. In this practice of the invention, the interior compartments are sealed so as to restrict flow of liquid or gelatinous material therefrom.

In yet another embodiment of this invention, the front panel includes handle means, e.g., a handle, thereon. Such a handle can provide ease of transportation.

DETAILED DESCRIPTION OF THE INVENTION

Figure 1:
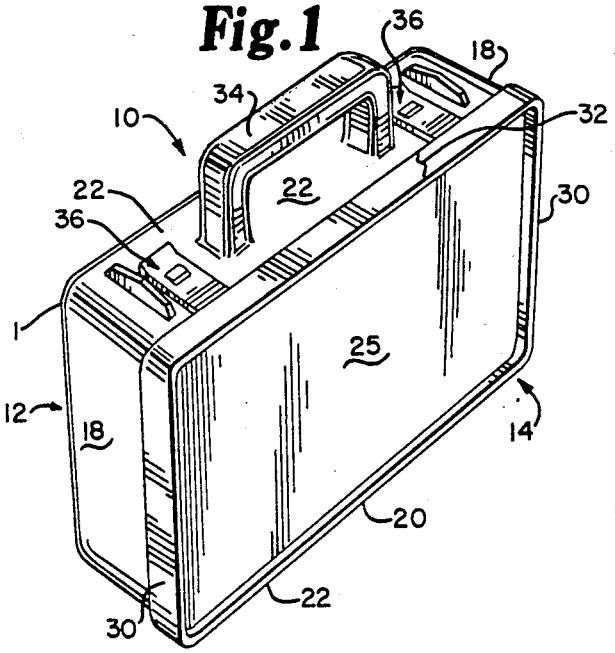
FIG. 1 is a perspective view of a preferred embodiment of the present invention.

FIGS. 1-7 illustrate one embodiment of the present invention wherein like reference numerals are used to refer to like features thereof. FIG. 1 is a perspective view of the embodiment illustrating one particular application of this invention, e.g., a lunch box. Although particularly disclosed with reference to transportation and storage of food products or comestibles, it is, of course, quite possible that other solid, liquid and/or gelatinous materials could be stored and transported by means of the present invention.

The embodiment of the invention in FIG. 1 comprises a transportation and storage device 10. Device 10 includes a compartmentalized bottom 12 and a cover or top 14. Bottom 12 is defined by a bottom panel 16, end or side panels 18, a back panel 20, and a front panel 22. End or side panels 18, back panel 20, and front panel 22 upstand from approximately the outer edges of bottom panel 16 to define the perimeter of bottom 12.

The cover or top 14 of device 10 comprises a top panel 26, a back rim 28, side or end rims 30, and a front rim 32. The embodiment of the invention shown in FIG. 1 includes an optional handle 34 and latch means, i.e., latches 36.

Figure 2:
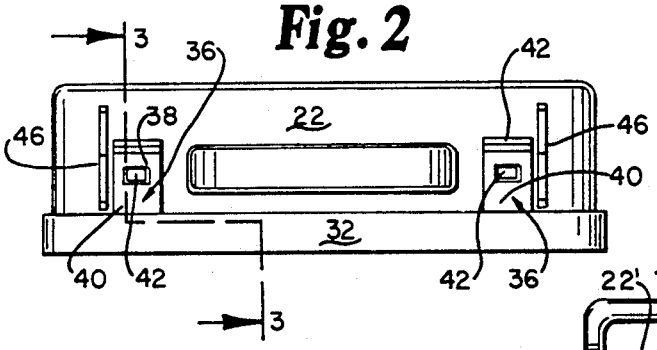
FIG. 2 is a front elevational view of the embodiment of the present invention depicted in FIG. 1 in an inverted orientation.

FIG. 2 is a front elevational view of the embodiment of the invention shown in FIG. 1 showing details of the exterior of front panel 22 and front rim 32. The latch means or latches 36 in FIG. 2 comprise a latch window 38 formed in a latch buckle or tab 40. In the embodiment depicted, a latch mating means or peg 42 projects outwardly from front panel 22 and engages the latch 36 through latch window 38.

In operation, latch 36 would be preliminarily moved over peg 42 while cover 14 would be pivotally urged toward bottom 12. As latch buckle or tab 40 is moved toward bottom panel 16, cover 14 would be more tightly urged against bottom 12. When latch 36 is completely engaged with window 38 around latch peg or tag 42, the latch means "snaps" into engagement, thereby holding cover 14 against bottom 12.

Shown in FIG. 2 are optional latch guards 46. Latch guards 46 are intended to protect latches 36 from being unintentionally disengaged and are coextensive to a significant degree with corresponding latches 36.

Figure 3:
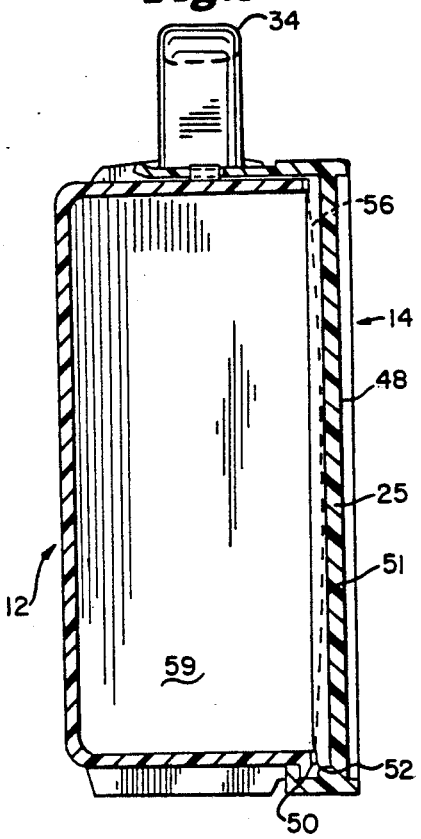
FIG. 3 is a sectional side elevational view of the invention depicted in FIG. 1 taken generally along line 3—3 in FIG. 2.

FIG. 3 shows a sectional view of the invention of FIG. 1 taken generally along line 3—3 in FIG. 2. Of significance in FIG. 3 is sealing panel 48 which overlies a portion of the interior of cover or top panel 26. Depending upon the application, sealing panel 48 may be manufactured as a single elastomeric, compressible member 51, provided the material is sufficiently resilient and provides a tight seal.

FIG. 3 also illustrates, in phantom, a convexly arcuate upper edge, or land 56, of an intermediate divider panel 59. Such an upper edge, or land 56, is illustrated as being embedded into sealing panel 48, cover 14 being securely attached in place to bottom 12. The arcuity of land 56 of divider panel 59 will be discussed in more detail hereinafter.

Any of a number of single composition materials or composite materials may be suggested for use in the sealing panel. A preferred material, KRATON G2706, commercially available from the Shell Corporation, can be utilized to fabricate sealing panel 48. KRATON G2706 is sufficiently compliant, having a Shore "A" hardness of 29, and also is approved by the federal Food and Drug Administration for direct contact with food. In addition, this material is resistant to tears and does not impart flavors or odors to food which might be kept in the device. Sealing panel 48 overlies a substantial portion of the interior of cover 14.

Sealing panel 48 can be restrictively held or fitted in place by the back, side or front rims 28, 30, 32 of cover 14, or by ribs 49 which can be provided in cover 14. Alternatively, sealing panel 48 may be bonded or sealed to the inside of cover 14. If bonding or sealing is employed to retain sealing panel 48, then care must be taken to ensure that neither adhesives nor adhesive solvents are permitted to come into contact with ny food kept in the device.

FIG. 3 also illustrates a preferred hinge mechanism useful with the present invention. The hinge means of FIG. 3 comprises an outwardly projecting hinge rib or lip 50 which is molded into back panel 20 adjacent its top edge to extend outwardly therefrom. Rib or lip 50 cooperates with a channel 52 which is molded into back rim 28 of cover 14. Channel 52, as shown, opens inwardly and cooperates with lip 50 to permit top 14 (and particularly sealing panel 48) to be held against the top edges or lands of the upstanding walls or panels which, in part, define bottom 12. The hinge means depicted in FIG. 3, in conjunction with the latch means, permit sealing panel 48 to be held in place to seal the compartments of bottom 12 (discussed more particularly below).

The continuous, single hinge means shown in the figures is preferred because it permits the cover to be removed from the bottom, e.g., for ease of cleaning the device. Multiple types of single hinges, well known in this art, could be employed.

Figure 4:
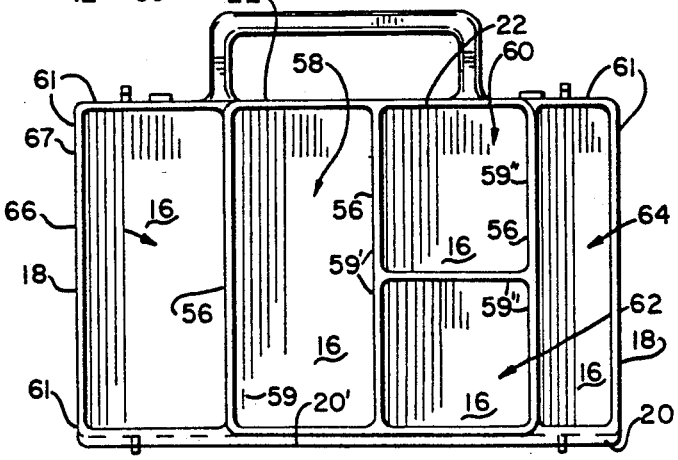
FIG. 4 is a top plan view of the bottom of the present invention with the cover or top removed.

FIG. 4 provides an interior detail of bottom 12. As shown, bottom 12 comprises a bottom panel 16, end or side panels 18 and back and front panels 20 and 22, respectively. Upstanding from bottom panel 16 are interior walls or dividers 59, 59' and 59''. Dividers 59, 59', 59'' divide bottom 12 into various compartments.

In the embodiment depicted, the heights of dividers 59, 59', and 59'' above the bottom panel 16 can be intentionally and selectively chosen so that sealed and unsealed compartments are created when top 14 is latched to bottom 12. Sealed compartments could be formed by manufacturing interior walls or dividers 59, 59', and 59'' so that upper edges, or lands 56, thereof are elevated with respect to upper edges, or lands 57 of end panels 18, the upper edge, or land, of centermost divider 59' being higher than the upper edges, or lands, of intermediate dividers 59, 59''. As a result, as the longitudinal center of the device is approached from end or side panels 18, the dividers become increasingly higher. Commensurate with this construction is the provision of back and front panels, 20, 22 which are provided with convexly arcuate upper edge portions, as at 61, extending between intermediate dividers 59, 59''.

It will be understood that, as previously discussed, the upper edge, or land 56, of intermediate divider 59 is also convexly arcuate. Similarly, the upper edges, or lands 56, of intermediate panels 59' and 59'' are also intended to be convexly arcuate in form. It will be appreciated, in view of this disclosure, that panels perpendicular to both of two mutually-perpendicular axes have arcuate upper edges. When such a structure is adopted, it is intended that each of these upper edges of the various planar, generally-vertical panels would lie in a portion of an imaginary spherical surface. The advantages obtained thereby will be discussed hereinafter.

As will be able to be seen then, in view of this disclosure, sealed compartments defined between back panel 20, front panel 22, and dividers 59, 59', 59'' are more efficiently sealed as a result of the tighter and more intimate engagement of sealing panel 48 by the arcuate upper edges, or lands 56, of dividers 59, 59', 59'' and the arcuate portions 61 of back panel 20 and front panel 22. As previously discussed, since the upper edges, or lands 56, of dividers 59, 59', 59'' and a portion of the upper edge of each of the back panel 20 and front panel 22 are convexly arcuate, those upper edges, together, lie in a portion of an imaginary spherical surface. Consequently, as sealing panel 48 and top panel 26 which carries sealing panel 48 are brought into engagement with these upper edges, there will be a tendency for the top-carried sealing panel 48 to be first engaged by the middle of the centermost intermediate divider panel 59'. As continued downward pressure is exerted upon top panel 26, it will be brought into conformance with the convexly arcuate surfaces it engages. As will be able to be seen in view of this disclosure, therefore, the normally-planar top panel will be made to assume a slightly curved form. The degree of curvature will, of course, be dependent upon the degree of arcuity of the various upper edges of the planar vertical walls or panels. The top panel is, of course, formed from a material which is sufficiently resilient so that deformation can occur without any permanent damage being occasioned.

Further, one will note, in view of this disclosure, that such a construction as described herein will better enable sealing to be accomplished by sealing panel 48. Because of the arcuate upper edges engaged by the panel 48, as latching of the top panel 26 to the bottom 12 is made to occur, the upper edges of the various panels will become embedded into the sealing panel 48.

In the embodiment of FIG. 4, compartments 58, 60, and 62 are sealed compartments as a result of this construction. These compartments 58, 60, 62 are defined within a perimeter defined by dividers 59 and 59" and portions of back panel 20 and front panel 22 having arcuate upper edges. All of these circumscribing panels or dividers are within the perimeter of sealing panel 48.

Figure 5:
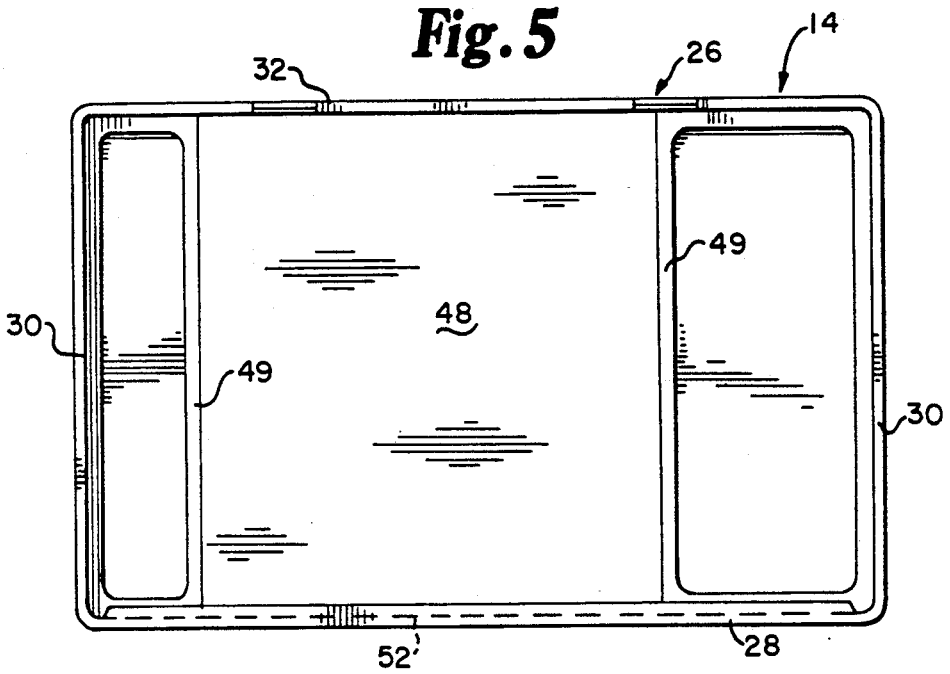
FIG. 5 is an inside view of the top or cover of the embodiment of the invention depicted in FIG. 1.

FIG. 5 shows an inside plan view of the top or cover of the device. Sealing panel 48, described above, interacts with the tops or lands 56 of the interior defining panels 59, 59', 59" of bottom 12. Lip or hinge channel 52 is indicated (in phantom) to be molded in back or bottom rim 28. Sealing panel 48 is shown as being set in with respect to top and bottom rims 28 and 32, respectively, and ribs 49.

Figure 6:
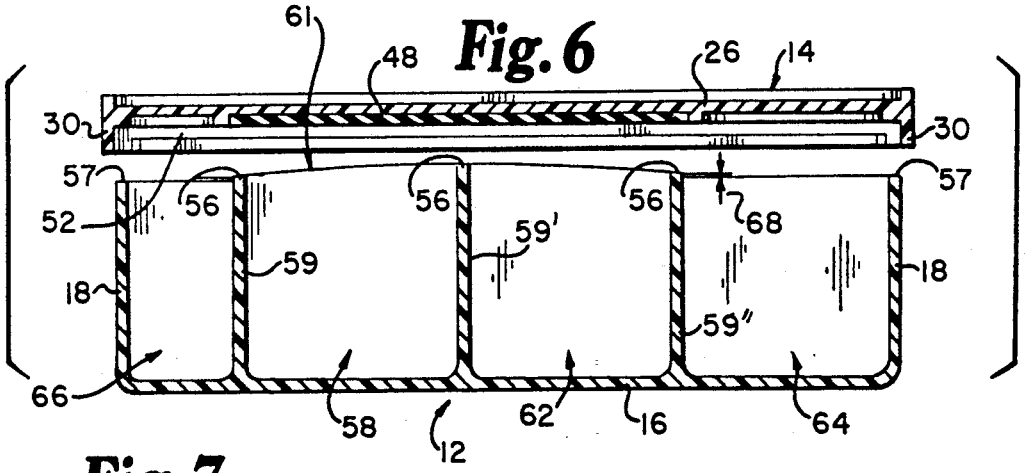
FIG. 6 is another sectional side elevational view of the invention taken at 90 degrees relative to the section shown in FIG. 3.

FIG. 6 is a view of the embodiment in section. More specifically, FIG. 6 illustrates the difference in height between the internal defining walls 59, 59', 59" and the end panels 18. As illustrated, interior compartment defining walls, 59, 59', and 59" are of a greater height than are side panels 18, and innermost panel 59' is of a greater height than dividers 59 and 59". Indicated at 68 is a difference in height between one side panel 18 and divider 59. This difference in height permits interior defining wall 59 to be forced into sealing panel 48 more securely or more tightly than are side panels 18. This means that, for example, compartments 58 and 62 would be sealed whereas compartments 64 and 66 would not be so sealed. Sealing occurs when cover 14 is aggressively or tightly urged against bottom 12 by means of, e.g., latches 36 and hinges 50, 52.

Figure 7:
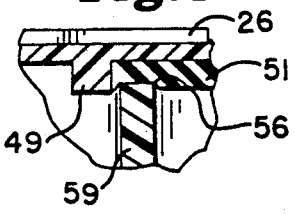
FIG. 7 is a detailed fragmentary sectional view of the invention shown in FIG. 6.

FIG. 7 is a fragmentary sectional view showing interaction between one of the upstanding interior compartment defining walls 59 and sealing panel 48. As shown, sealing panel 48 comprises compressible member 51. The top or land 56 of wall segment or divider 59 compresses elastomeric seal member 51 thereby creating a tightly sealed compartment.

The device of the present invention may be molded from any of a variety of thermosetting or thermoplastic polymeric materials. The particular qualifications are that the material chosen should be sufficiently rigid to urge the cove and bottom hereof against each other sufficiently aggressively so as to create the desired type of seal.

The exterior panel portions may be molded from, for example, polypropylene. Polypropylene is particularly advantageous in the practice of the present invention because it is both sufficiently rigid and approved for direct contact with food. Polypropylene also cleans relatively easily and stands up to the type of environment in which, for example, lunch boxes would be used.

As described above, it is possible to select a number (or all) of the compartments which are to be sealed. Whether all compartments, or less than all compartments, are to be sealed is within the discretion of the manufacturer. In the embodiment illustrated, it is intended that interior compartments be tightly sealed so as to permit items, such as oranges, apple slices, and other fruit portions to be stored therein. Exterior compartments could be molded so as not to be sealed. Such unsealed compartments would then be used, for example, to contain cans of beverages, napkins, eating utensils and the like.

An advantage achieved in the practice of the present invention is to avoid the use of individual food wrappings or food containers utilized within the container. This permits the user to purchase bulk quantities of food to be carried and stored in this container, e.g., for lunch, and simply pour or place a desired smaller quantity within the sealed compartments of the device. In this way, substantial savings on initial food cost and wrapping costs are achieved.

Further, the problem of how to dispose of slowly biodegradable food wrappers and food containers also is solved. Such materials are not required to transport and store food in the utilization of the present invention.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. Transporting and storage apparatus, comprising:
(a) a housing including a bottom panel and four generally planar panels extending substantially orthogonal to said bottom panel to define a generally rectangular compartment therewithin; and
(b) a normally-planar closure panel having a lower surface carrying an elastomeric, compressible seal of a size at least as great as an area defined by upper edges of said panels generally orthogonal to said bottom panel of said housing, said seal intimately cooperating with said upper edges of said panels orthogonal to said bottom panel when said closure panel is brought into engagement with a top of said housing to seal said compartment;
(c) wherein one of said housing and said closure panel defines a convexly arcuate engagement surface, and the other of said housing and said closure panel is resilient so as to conform, when said housing and said closure panel is are brought into engagement with one another, to said one of said housing and said closure panel defining said convexly arcuate engagement surface.

2. Transporting and storage apparatus, comprising:
(a) a housing including a bottom panel and four generally planar panels extending substantially orthogonal to said bottom panel to define a generally rectangular compartment therewithin; and
(b) a normally-planar closure panel having a lower surface carrying an elastomeric, compressible seal of a size at least as great as an area defined by upper edges of said panels generally orthogonal to said bottom panel of said housing, said seal intimately cooperating with said upper edges of said panels orthogonal to said bottom panel when said closure panel is brought into engagement with a top of said housing to seal said compartment;
(c) wherein one of said housing and said closure panel defines a convexly arcuate engagement surface, and one of said housing and said closure panel is non-resilient and the other of said housing and said closure panel is resilient so as to conform, when said housing and said closure panel are brought into engagement with one another, to said one of said housing and said closure panel which is non-resilient.

3. Transporting and storage apparatus, comprising:
(a) a housing including a bottom panel and four generally planar panels extending substantially orthogonal to said bottom panel to define a generally rectangular compartment therewithin, upper edges of two of the panels substantially orthogonal to said bottom panel and which are opposite one another being convexly arcuate and parallel to one another; and (b) a normally-planar deformable closure panel having a lower surface carrying an elastomeric, compressible seal of a size at least as great as an area defined by said upper edges of said panels generally orthogonal to said bottom panel of said housing, said seal intimately cooperating with said upper edges of said panels orthogonal to said bottom panel when said closure panel is brought into engagement with a top of said housing to seal said compartment.

4. Apparatus according to claim 3 wherein said seal substantially conforms in size and shape to a form defined by upper edges of said four generally planar panels which extend substantially orthogonal to said bottom panel, and wherein peripheral edges of said seal are intimately engaged by said upper edges when said closure panel is brought into engagement with said top of said housing.

5. Apparatus according to claim 3 wherein said seal comprises a polymeric material.

6. Transporting and storage apparatus, comprising:

(a) a housing including a bottom panel and four generally planar panels extending substantially orthogonal to said bottom panel to define a generally rectangular compartment therewithin, upper edges of the panels which are substantially orthogonal to said bottom panel which are opposite one another being convexly arcuate and parallel to one another to define arcuate segments which lie in a common imaginary portion of a spherical surface; and (b) a normally-planar, resilient closure panel having a lower surface carrying an elastomeric, compressible seal of a size at least as great as an area defined by said upper edges of said panels generally orthogonal to said bottom panel of said housing, said seal intimately cooperating with said upper edges of said panels orthogonal to said bottom panel, when said closure panel is brought into engagement with a top of said housing, to seal said compartment.

7. Transporting and storage device, comprising:

(a) a housing including a bottom panel, front and back panels extending from said bottom panel generally orthogonal thereto, a pair of side panels extending from said bottom panel generally orthogonal thereto, and a pair of intermediate divider panels extending from said bottom panel generally orthogonal thereto, upper edges of said intermediate divider panels being convexly arcuate and spaced upwardly from upper edges of said side panels, and upper edges of said front and back panels having parallel and linear portions intermediate a side panel and an adjacent intermediate divider panel, and convexly arcuate portions between said intermediate divider panels; and (b) a normally-planar, deformable closure panel conforming substantially in size and shape to a form defined by said upper edges of said front, back, and side panels of said housing, said closure panel including integral front, back, and side rims, a lower surface of said closure panel carrying an elastomeric, compressible seal conforming substantially in size and shape to a form defined by said upper edges of said intermediate divider panels and said convexly arcuate portions of said upper edges of said front and back panels, said seal being carried by said closure panel so that, when said closure panel is placed in an intended position with respect to said upper edges of said front, back, and side panels of said housing, said seal is compressed by said closure panel against said upper edges of said intermediate divider panels and said convexly arcuate portions of said front and back panels.

8. Apparatus according to claim 7 further comprising a hinge located on said back panel and on said back rim, and a latch located on said front panel and said front rim.

9. Apparatus according to claim 8 comprising a handle located on said front panel between said latch.

10. Apparatus according to claim 7 wherein said seal comprises a polymeric material.

11. Apparatus according to claim 7 wherein said housing and said closure panel are fabricated from polypropylene.

12. Apparatus according to claim 7 comprising a latch and a hinge.

13. Apparatus according to claim 7 wherein a compartment defined between said front and back panels and said intermediate divider panels is sealed, and wherein compartments defined between said side panels and respective adjacent intermediate divider panels are not sealed.

14. Apparatus according to claim 13 further comprising at least one additional divider panel, substantially orthogonal to said bottom panel, within said sealed compartment to sub-divide said sealed compartment, and wherein an upper edge of said at least one additional panel is at a height so that, when said closure panel closes a top of said housing, said upper edge of said at least one additional divider panel is in intimate contact with said seal.

* * * * *